US006672366B1

(12) United States Patent
Wade et al.

(10) Patent No.: US 6,672,366 B1
(45) Date of Patent: Jan. 6, 2004

(54) FRENCH DOOR COVERING

(76) Inventors: Bette Wade, 4205 Roselake Dr., Greensboro, NC (US) 27407; Trudy Lynn Wade, 4011 Bramble Tye, Greensboro, NC (US) 27407

( * ) Notice: Subject to any disclaimer, the term of this patent is extended or adjusted under 35 U.S.C. 154(b) by 0 days.

(21) Appl. No.: 09/996,297

(22) Filed: Nov. 28, 2001

(51) Int. Cl.[7] ..... A47G 5/00
(52) U.S. Cl. ..... 160/371; 160/90; 160/368.1
(58) Field of Search ..... 160/330, 90, 368.1, 160/371, 395; 52/202

(56) References Cited

U.S. PATENT DOCUMENTS

| | | | | | |
|---|---|---|---|---|---|
| 4,020,826 | A | | 5/1977 | Mole | 126/270 |
| 4,294,055 | A | * | 10/1981 | Andresen | 52/795 |
| 4,416,096 | A | | 11/1983 | Schuster et al. | 52/202 |
| 4,486,990 | A | | 12/1984 | Bauch | 52/202 |
| 4,874,028 | A | * | 10/1989 | Lynch et al. | 160/332 |
| 4,891,921 | A | * | 1/1990 | Governale | 52/207 |
| 4,966,405 | A | * | 10/1990 | Tremaine et al. | 296/95.1 |
| 5,042,656 | A | * | 8/1991 | Kahre | 206/321 |
| 5,230,376 | A | * | 7/1993 | Woodruff et al. | 160/90 |
| 5,255,464 | A | * | 10/1993 | Marecek | 40/591 |
| 5,328,729 | A | * | 7/1994 | Lamonte, Jr. | 428/14 |
| 5,465,774 | A | * | 11/1995 | Smith | 160/90 |
| 5,632,318 | A | * | 5/1997 | Wang | 160/370.21 |
| 5,700,036 | A | * | 12/1997 | Smith, III | 283/72 |
| 5,732,759 | A | * | 3/1998 | Wang | 160/370.21 |
| 5,732,760 | A | * | 3/1998 | Pattison | 160/371 |
| 5,922,437 | A | * | 7/1999 | Bryant | 428/102 |
| 5,996,674 | A | * | 12/1999 | Gatewood | 160/348 |
| 6,026,886 | A | * | 2/2000 | Diamond-Martinez | 160/113 |
| 6,059,005 | A | * | 5/2000 | Zinbarg | 160/90 |
| 6,089,301 | A | * | 7/2000 | Smith | 160/90 |
| 6,145,573 | A | * | 11/2000 | Chen | 160/368.1 |
| 6,257,307 | B1 | * | 7/2001 | Tollivar | 160/368.1 |
| 6,499,528 | B1 | * | 12/2002 | Johnson | 160/350 |
| 6,539,966 | B2 | * | 4/2003 | Raines, Jr. et al. | 135/901 |
| 6,547,304 | B1 | * | 4/2003 | Conner et al. | 296/79 |
| 2003/0009946 | A1 | * | 1/2003 | Wilson | 49/74.1 |

* cited by examiner

*Primary Examiner*—Bruce A. Lev
(74) *Attorney, Agent, or Firm*—MacCord Mason PLLC

(57) ABSTRACT

A plurality of barriers cover windows in French doors in which the window in each door has a first area smaller than a second area of the French door in which it is located. Each barrier includes a rigid frame defining a third area larger than the first area. First and second fabric covers stretched on opposite sides of the frame provide opacity and decoration. The barrier is hung on a French door so that the window is covered by the barrier without tools or manipulation of parts. The decorative fabric covers cooperate with one another to make a unitary decorative scene.

22 Claims, 4 Drawing Sheets

FRENCH DOOR COVERING

BACKGROUND OF THE INVENTION

The present invention relates to window coverings and more particularly to window coverings for covering windows in doors, although the window coverings can certainly be applied to windows in walls, as well as in doors. In French doors, windows occupy a large portion of the area of the door, which provides a very pleasing architectural and visual statement for homes or buildings. The open windows allow outdoor light to come in and brighten a room, as well as providing occupants of a room a way to see outdoors to enjoy nature or other outdoor views. As a result, French doors and other doors with windows (hereinafter collectively referred to as "French doors") have become quite popular.

Conventional French doors are formed with a door frame made traditionally of wood, or other materials such as vinyl or metal. Within the area of the door, openings are formed in which window panes are arranged, separated and supported by divider elements called mullions. In traditional French doors, the mullions have a thickness substantially equal to the overall thickness of the door but rise substantially out of the plane of the glass of the windows. Some French door designs have mullions and surrounding glazing elements of the panes which rise even further above the plane of the main door frame.

Another attempt to provide coverings for doors with windows in them is exemplified by U.S. Pat. No. 6,089,301 to Smith. In the Smith patent, doors having windows without mullions are provided with a privacy screen. However, the screens are sized to be about the area of the glass, so that they fit against the glass and are therefore recessed from the main plane of the door. This is only possible because Smith addresses a door that has no mullions. Screens like Smith's are not workable with a French door in which the mullions stand in the way and prevent the screens from being recessed directly onto the glass.

At nighttime, it is desired to provide privacy and, sometimes in the daytime it is desired to have privacy, or to reduce the ingress of ambient light. The Smith screens are acceptable for such purposes for the doors addressed in the Smith patent. However, they are not workable alternatives for French doors having mullions.

Accordingly, there is a need in the art for a screen for a French door to enable it to be covered when privacy or light blockage is desired, and to be removed when not desired.

SUMMARY OF THE INVENTION

The present invention fulfills this need in the art by providing a barrier for covering a window in a French door in which the window has a first area and the French door has a second area, the second area being larger than the first area. A frame defines a rigid perimeter around a third area that is larger than the first area and smaller than the second area. First and second fabric covers are located on opposite sides of the frame, and a means for hanging the barrier on a French door is provided so that the window is covered by the barrier.

The first and second fabric covers may be stretched across the frame. One of the fabric covers preferably provides opacity to the barrier. The fabric cover that provides opacity preferably faces the door when the barrier is hung on the door. One of the fabric covers is, desirably, decorative. The fabric cover that is decorative typically faces away from the door when the barrier is hung on the door.

The means for hanging typically permits the barrier to be hung on or removed from the French door without tools or manipulation of parts. In one embodiment the means for hanging includes a projection from one side of the barrier that cooperates with a sawtooth-topped strap affixed to the French door. In another, the hanging means includes a receiver on the frame that cooperates with one or more hooks on the French door.

The frame may be a wooden frame and may have mitered corners. In another embodiment the frame is a rigid plastic. Other suitable materials may be substituted.

The first and second fabric covers may be joined together to make a sleeve, with the frame is inserted within the sleeve.

The invention may take the form of a plurality of barriers. In this embodiment one of the fabric covers of each barrier is decorative, and each decorative fabric cover is unique from the decorative fabric covers of the other barriers. The decorative covers of the plurality of barriers preferably cooperate to make a unitary decorative scene.

The invention also provides a method of decorating and providing privacy to a room with a French door that has a window in it. The method includes at selected times, hanging on the French door a rigidly-framed barrier that has an area larger than the window in the French door, so that a view through the window is blocked by the barrier and covered with a decorative image on the barrier. At other selected times, the barrier is removed from the French door to allow light to pass from outdoors into a building and to allow occupants of the building to see out of the window in the door.

Hanging preferably includes hanging on multiple French doors to make a composite decorative image. Hanging may also include hanging an opaque barrier to black out outside light from the building. Hanging preferably includes lowering an upper frame section of the barrier onto a support on the French door.

The method may also include storing a removed barrier away from the window in the French door.

Removing may include raising an upper frame section of the barrier off of a support on the French door.

BRIEF DESCRIPTION OF THE DRAWINGS

The invention will be better understood by a reading of the Detailed Description of the Preferred Embodiments along with a review of the drawings, in which.

DETAILED DESCRIPTION OF THE PREFERRED EMBODIMENT

Figure 1:
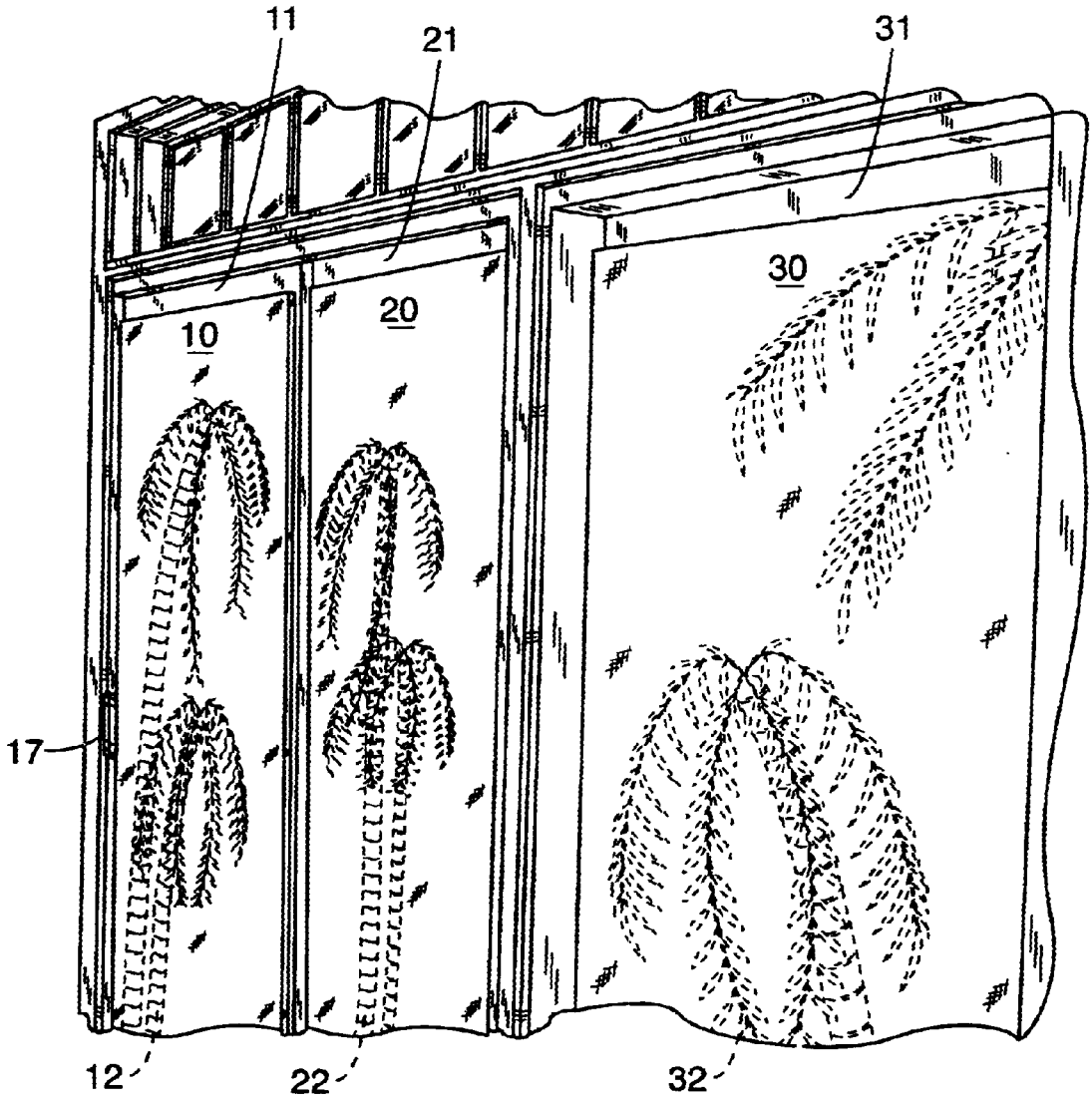
FIG. 1 is a perspective view of several adjacent doors having barriers according to a first embodiment of the invention.

FIG. 1 shows the invention as implemented on French doors, 11, 21, and 31. Door 11 is covered with a barrier 10; door 21 is covered with barrier 20; and door 31 is covered with a barrier 30. Each barrier is provided with a distinctive covering 12, 22, 32. The decorative coverings however, cooperate with one another to provide a unitary scene when applied side by side on the doors. The barriers are backed by an opaque, black-out cloth, not seen in FIG. 1. Preferably, the fabrics are stretched taut across the barrier.

Merriam Webster's Collegiate Dictionary defines "French door" as a door with rectangular glass panes extending the full length; see http://www.m-w.com/cgi-bin/dictionary?French+door. Typically, French Doors have mullions between the panes, and the invention is particularly suitable for accommodating such doors, because the mullions do not interfere with the placement and removal of the barriers. In fact, the invention is particularly useful for doors with mullions and/or surrounding glazing supports that are raised from the main door surface. However, the barrier of the invention is also useable with a door with a single, large glass pane.

Also as seen in FIG. 1 the door 31 is stationary, as is the door 21, with the door 11 being mounted as a sliding door and provided with a handle 17. As can be appreciated, the door 11 cannot be slid while the screen 20 is in place. However, when the door is closed, the screens may cover the respective doors and provide privacy and the exclusion of outdoor light from the inside of the room. The barriers 10, 20, 30 are sized to be larger than the windows in the doors, but smaller than the doors themselves. When the barriers are in place, the windows are covered, but the edges of the door frames continue to be seen. The screens are supported on the doors by having a top rail of a rigid perimeter frame of each screen hung on a supporting means on the door. Various designs of supporting means can be used, and these will be described hereinafter.

Figure 2:
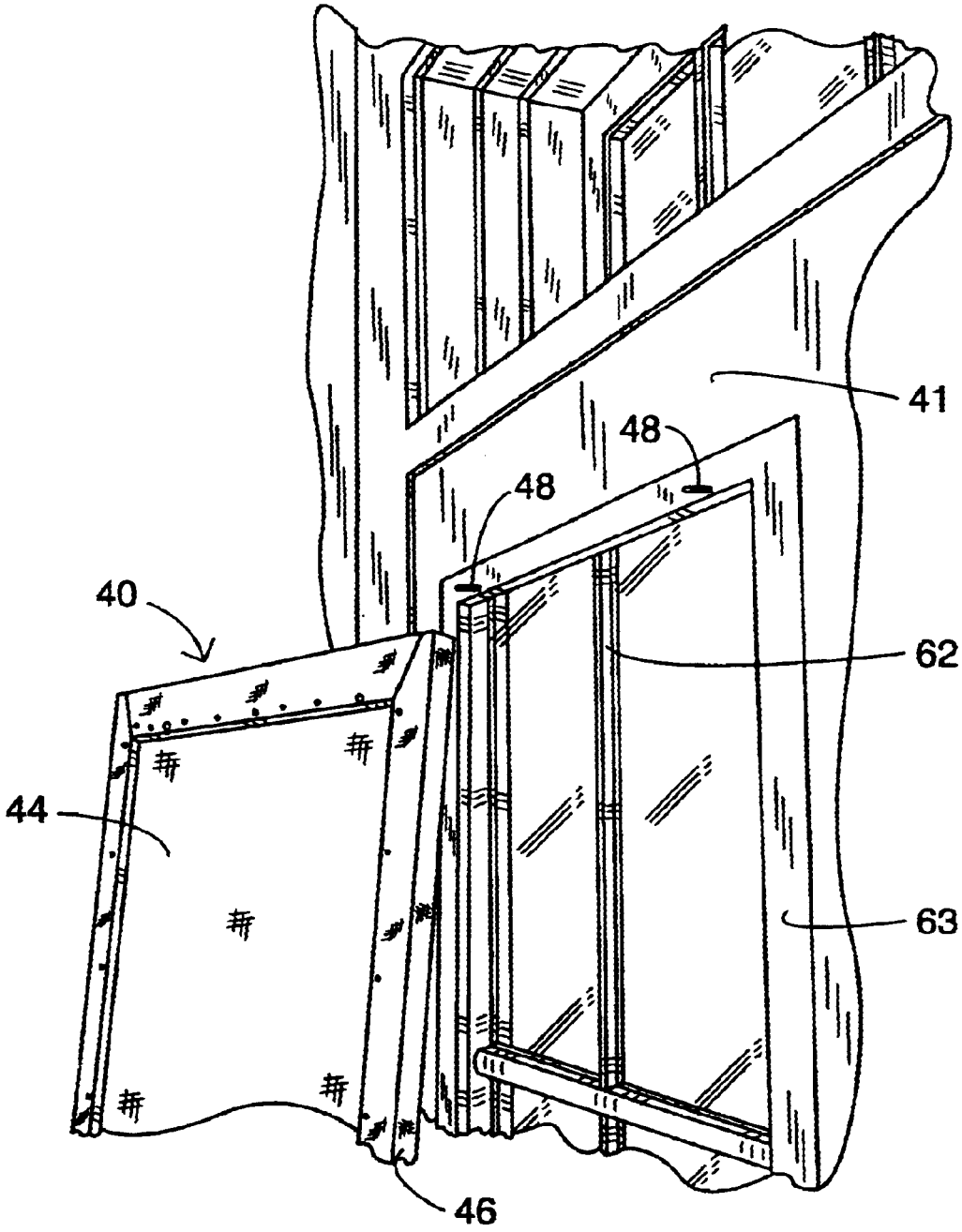
FIG. 2 is a perspective view of one door with the barrier removed and reversed.

Referring now to FIG. 2, a door 41 is shown having a raised mullion 62 and including a raised peripheral glazing 63. The glazing surrounds a window area (including multiple panes) that is smaller than the door area. That is, mullion 62 and glazing 63 project inwardly into the room from the main plane from the door 41. Mounted in the top portion of the glazing 63 are two protruding hooks or posts 48. Also shown in FIG. 2 is a barrier 40 having a rigid peripheral frame 46 and a black out cloth 44 providing opacity to the entire barrier. The frame 46 can be configured as a conventional artist's canvas structure and have an ornamented canvas stretched over it to provide the decorative fabric cover. Other forms of decorative covers can be provided based upon esthetic considerations. As seen in FIG. 2, the rigid frame 46 provides rigidity to the entire barrier 40, so that it can be picked up and transported by grasping the frame 46. The top rail of the frame 46 can be placed upon and supported by the posts 48 to position the screen over the window in the door 41. When it is desired to remove the barrier, the barrier is simply lifted off of the posts 48. The frame 46 described for barrier 40 is representative of the frames for the barriers 10,20,30.

Figure 3:
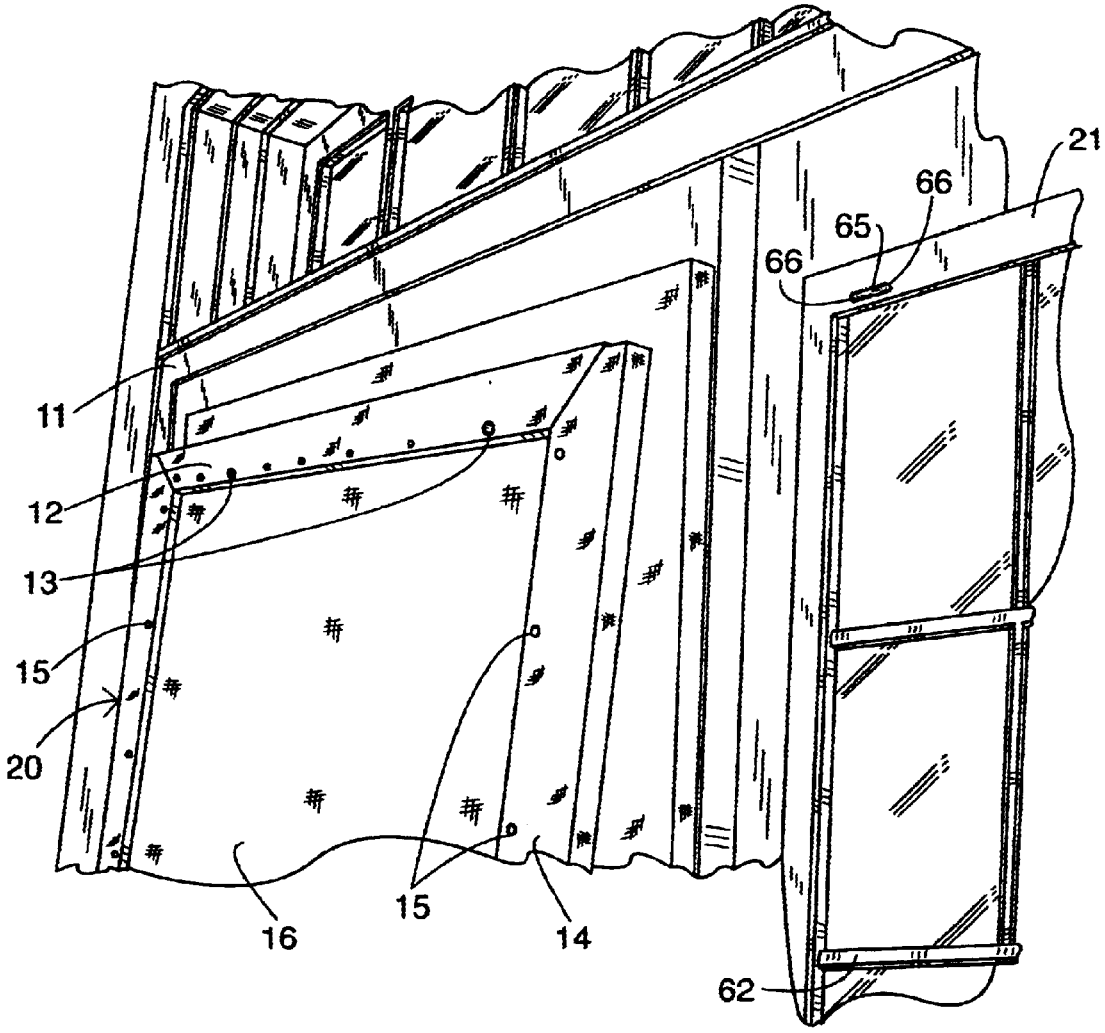
FIG. 3 is a perspective view of a door with its barrier removed and reversed for an alternate embodiment.

FIG. 3 shows barrier 20 reversed from its position as seen in FIG. 1. As can be seen, the decorative fabric cover 12 is held in place with a plurality of nails 15 on the frame 14. Black-out cloth 16 is secured in place behind the decorative side of the decorative cover 12 with adhesive or other binder to provide opacity and prevent the passage of light. As seen in FIG. 3, posts 13 are provided projecting rearwardly from the top rail of the frame 14.

Door 21 is provided with mullions 62 and affixed to its upper frame portion is a hanging means in the form of a sawtooth strap 65. The sawtooth-topped strap 65 is a strap of metal having a sawtooth pattern on its upper edge. The strap is affixed to the door frame with nails 66. Thus, the barrier 10 can be supported on the sawtooth-topped straps 65 by locating the projecting posts 13 on corresponding strap locations 65. This mounting arrangement provides for a minimal room-direction projection from the door 21 for the mounting means, which is particularly suitable for a door over which an additional sliding door will pass. Again, the barrier 10 can be lifted off of the strap 65 or lifted and laterally positioned at a desired location on strap 65.

The means for hanging the barrier may take the form of a projection from one side of the barrier that cooperates with a sawtooth-topped strap affixed to the French door. The hanging means may also take the form of a receiver on the frame such as the top rail of the frame that cooperates with a post or hook on the French door. Any suitable apparatus that supports the barrier when it is in place on the door and may be deemed a hanging means or equivalent under 35 USC 112, paragraph 6. Preferably, no tools or parts manipulation are needed to place and remove the barriers on the doors once they hanging means are in place. Typically, the barrier will be surface mounted on the door when hung using the means for hanging. As a result, the space between the barrier and the window glass becomes a relatively quiet "dead air" space, to provide insulation value, as well.

Figure 4:
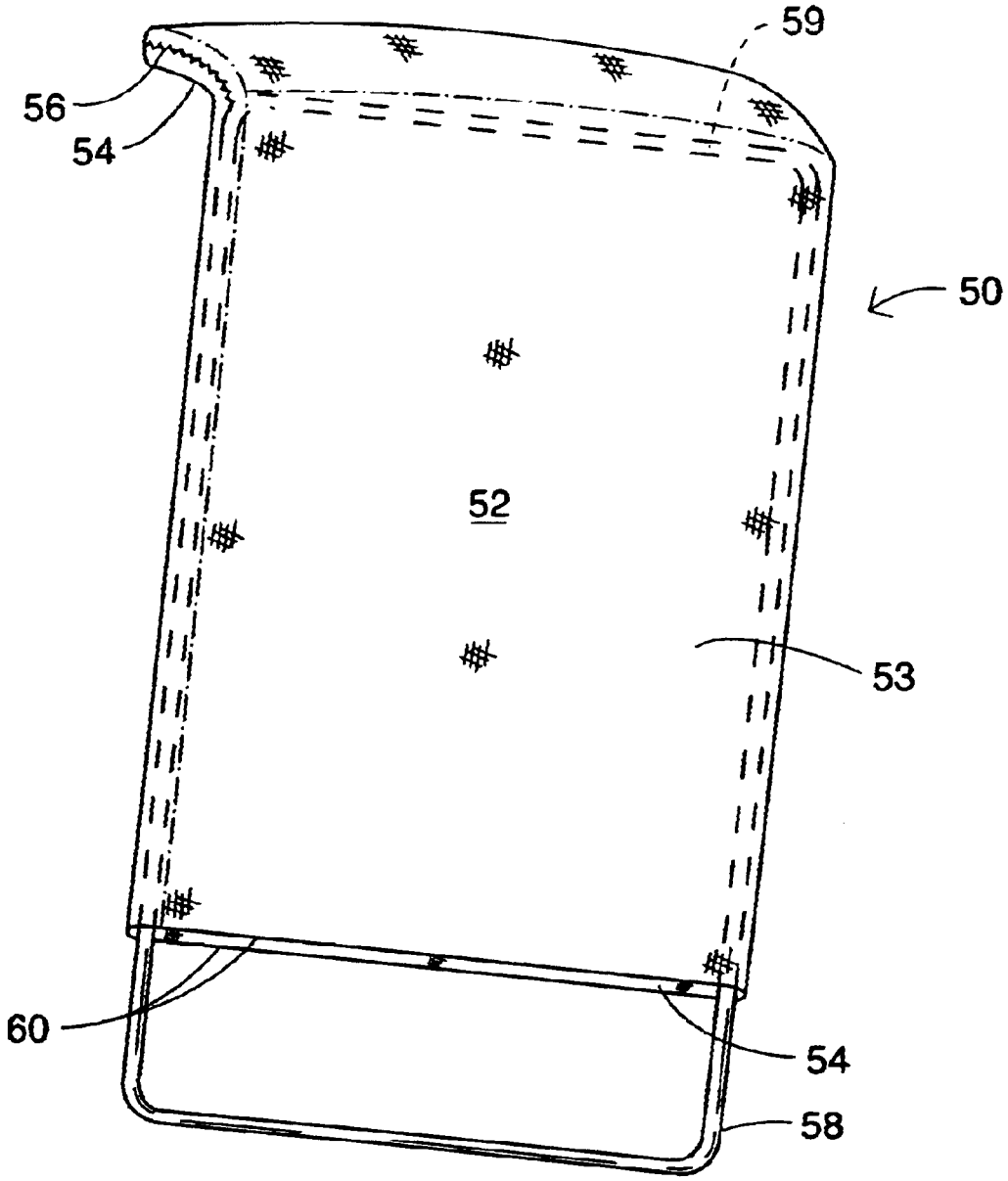
FIG. 4 is a perspective view of another embodiment.

As seen in FIG. 4, an alternate embodiment 50 of the barrier can be seen. A sleeve 52 is formed of a decorative front fabric 53 and a rear blackout fabric 54. The front face 53 is shown joined to the blackout fabric along a seam line 56. The frame 58 is shown being inserted into the sleeve 52, with its insertion not yet complete. Upon completion of insertion, the lower end 60 of the sleeve can be closed in any desired fashion, such as by closing a zipper, affixing Velcro, or stitching. Alternatively, the bottom could be left open. In this embodiment, the frame 58 may desirably be a plastic material such as a hollow plastic tubing like a hula-hoop material, or other suitable material. Once the frame 58 is inserted into the sleeve, the bottom is closed and the upper reach 59 of the frame can be provided with pins through the sleeve for mounting on a strap, (like strap 65 shown in FIG. 3). Alternatively, a post on the door (like post 48) can support the upper reach 59 when the barrier is installed.

Other embodiments for providing a barrier in accordance with the invention are also contemplated, such as fabric panels sewn together with peripheral sleeves into which separate peripheral frame elements are inserted to provide rigidity to the entire barrier.

As can be appreciated, the barrier can be put in place on a door without regard to whether or not mullions are present in the door. In place, they provide a decorative cover, provide privacy, and prevent the ingress of outdoor light. When such covering is not desired, the panels can be simply picked up and transported out of the way for storage in a closet or similar facility.

Certain modifications and improvements will occur to those skilled in the art upon reading the foregoing description. It should be understood that all such modifications and improvements have been omitted for the sake of conciseness and readability, but are properly within the scope of the following claims.

What is claimed is:

1. In combination with a French door having a glass window in which the window has a first area that is smaller than the area of the French door, a barrier adapted to be secured to the interior of the French door comprising a frame defining a rigid perimeter around a third area that is larger than the window and smaller than the door, first and second fabric covers on opposite sides of the frame, and means for removably hanging the barrier on the French door so that the window is covered by the barrier.

2. A barrier as claimed in claim 1 wherein the first and second fabric covers are stretched across and cover the frame.

3. A barrier as claimed in claim 1 wherein one of the fabric covers provides opacity to the barrier.

4. A barrier as claimed in claim 3 wherein the fabric cover that provides opacity faces the door.

5. A barrier as claimed in claim 1 wherein one of the fabric covers is decorative.

6. A barrier as claimed in claim 5 wherein the fabric cover that is decorative faces away from the door.

7. A barrier as claimed in claim 1 wherein one of the fabric covers provides opacity to the barrier and the other fabric cover is decorative.

8. A barrier as claimed in claim 1 wherein the means for hanging permits the barrier to be hung on or removed from the French door without tools or manipulation of parts.

9. A barrier as claimed in claim 1 wherein the frame is a wooden frame.

10. A barrier as claimed in claim 1 wherein the frame is a rigid plastic.

11. A barrier as claimed in claim 1 wherein the first and second fabric covers are joined together to make a sleeve and the frame is inserted within the sleeve.

12. A barrier as claimed in claim 1 wherein the means for hanging includes a projection from one side of the barrier that cooperates with a sawtooth-topped strap affixed to the French door.

13. A barrier as claimed in claim 1 wherein the hanging means includes a receiver portion on the frame that cooperates with a post or hook on the French door.

14. A plurality of barriers and French doors as claimed in claim 1, wherein the French doors are adjacent one another and one of the fabric covers of each barrier is decorative and each decorative fabric cover is unique from the decorative covers of the other barriers, and the decorative covers of the plurality of barriers cooperate to make a unitary decorative scene as hung on the plurality of French doors.

15. A plurality of barriers and a plurality of French doors for covering windows on the French doors, each French door having a glass window that has a first area smaller than a second area of the French door in which the window is located, each barrier comprising a frame defining a rigid perimeter around a third area that is larger than the first area and smaller than the second area, first and second fabric covers stretched on opposite sides of the frame, wherein one of the fabric covers provides opacity to the barrier and the other fabric cover is decorative, and means for hanging the barriers from the French doors so that the windows are covered by the barriers, the means for hanging permitting the barriers to be hung on or removed from the French doors without tools or manipulation of parts, wherein the decorative fabric cover of each barrier is unique from the decorative covers of the other barriers, and the decorative covers of the plurality of barriers cooperate with one another when hung on the French doors to make a unitary decorative scene.

16. A method of decorating and providing privacy to a room with a French door that has a window in it comprising at selected times, hanging on the French door a rigidly-framed barrier that has an area larger than the window in the French door, so that a view through the window is blocked by the barrier and covered with a decorative image on the barrier, and at other selected times, removing the barrier from the French door to allow light to pass from outdoors into a building and to allow occupants of the building to see out of the window in the door.

17. A method as claimed in claim 16 wherein hanging includes hanging on multiple French doors to make a composite decorative image.

18. A method as claimed in claim 16 wherein hanging includes hanging an opaque barrier to black out outside light from the building.

19. A method as claimed in claim 16 further comprising storing a removed barrier away from the window in the French door.

20. A method as claimed in claim 16 wherein hanging includes lowering an upper frame section of the barrier onto a support on the French door.

21. A method as claimed in claim 16 wherein removing includes raising an upper frame section of the barrier off of a support on the French door.

22. A method of decorating and providing privacy to a room with French doors that have windows in them comprising at selected times, hanging on the French doors, rigidly-framed, opaque barriers that have an area larger than the windows in the French doors, so as to black out outdoor light from the room, block views through the windows and cover the windows with decorative images on the barriers to make a composite decorative image, including lowering upper frame sections of the barriers on to supports on the French doors, and at other selected times, removing the barriers from the French doors to allow light to pass from outdoors into the room and to allow occupants of the room to see out of the windows, including raising upper frame sections of the barriers off of supports on the French doors and storing removed barriers away from the windows in the French doors.

* * * * *